US006130032A

United States Patent [19]

Tang et al.

[11] Patent Number: 6,130,032

[45] Date of Patent: Oct. 10, 2000

[54] PHOTOGRAPHIC ELEMENTS CONTAINING IMPROVED YELLOW DYE-FORMING COUPLERS

[75] Inventors: Ping W. Tang; James H. Reynolds, both of Rochester; Daniel E. Corcoran, Webster, all of N.Y.

[73] Assignee: Eastman Kodak Company, Rochester, N.Y.

[21] Appl. No.: 08/938,719

[22] Filed: Sep. 26, 1997

[51] Int. Cl.[7] ..... G03C 7/30

[52] U.S. Cl. ..... 430/557

[58] Field of Search ..... 430/557

[56] References Cited

U.S. PATENT DOCUMENTS

| | | | |
|---|---|---|---|
| 4,401,752 | 8/1983 | Lau et al. | 430/557 |

FOREIGN PATENT DOCUMENTS

| | | |
|---|---|---|
| 322-904 | 5/1989 | European Pat. Off. . |
| 383637 | 8/1990 | European Pat. Off. . |
| 61-238057 | 4/1960 | Japan . |
| 61-233741 | 4/1985 | Japan . |
| 63-133151 | 4/1988 | Japan . |
| 3-75642 | 8/1989 | Japan . |
| 3-67255 | 3/1991 | Japan . |
| 4-139446 | 5/1992 | Japan . |
| 4-368936 | 12/1992 | Japan . |

*Primary Examiner*—Janet Baxter
*Assistant Examiner*—Amanda C. Walke
*Attorney, Agent, or Firm*—Arthur E. Kluegel

[57] ABSTRACT

A photographic element exhibiting improved yellow dye stability comprises a light sensitive silver halide emulsion layer having associated therewith a yellow dye forming coupler having the formula:

(I)

wherein:

$R^1$ and $R^2$ in the formula are independently selected alkyl, aryl, amino or heterocyclic groups, each free of hydrogen bonded to the atom linking the group to the rest of the coupler;

$R^3$ is a H or a substituent;

X is C, S, or P, and n is 1 or 2;

each Z is an independently selected substituent group substitutable to a phenyl ring provided that at least one such group is an electron withdrawing group and s is 1 to 3;

each Y is an independently selected substituent group and r is 1 to 3.

16 Claims, No Drawings

PHOTOGRAPHIC ELEMENTS CONTAINING IMPROVED YELLOW DYE-FORMING COUPLERS

FIELD OF THE INVENTION

This invention relates to a silver halide photographic element containing a new class of yellow coupler useful for improving the dark (heat/wet) stability of the resulting yellow image dye. The coupler is an acyl acetanilide having a particular phenoxy coupling-off group.

BACKGROUND OF THE INVENTION

Finished silver halide photographic films and papers are stored under a wide variety of conditions. Temperature and humidity serve to accelerate degradation of such photographic materials. The resistivity of the image dye to these conditions is crucial for retaining the color vividness of the original image dyes. In particular, yellow image dyes derived from pivaloylacetanilide containing an aryloxy coupling-off group (as shown in formula (II)), are very sensitive to the keeping conditions such as high temperature and high humidity.

(II)

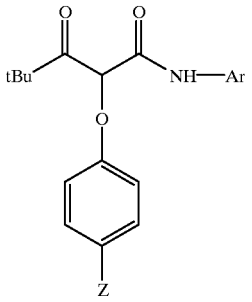

These needs are especially important in photographic elements designed as reversal elements designed for projection viewing.

Pivaloylacetanilide yellow couplers which are frequently used in the art suffer, in general, from low coupling activity due to the high pKa value of the couplers. To overcome the problem associated with the low coupling activity, aryloxy groups have been widely used as the coupling-off-group (COG) in order to enhance the coupling activity. Pivaloylacetanilide yellow couplers containing aryloxy COGs are disclosed in such patents as U.S. Pat. Nos. 3,408,194, 3,419,319, 3,429,391, 3,476,563, 3,644,498, 3,822,248, and 4,248,962.

U.S. Pat. No. 4,401,752 discloses that the coupling activity of the above-identified yellow couplers can be further enhanced by incorporating a polarizable group, such as alkanamido or alkanesulfonamido groups at the ortho position. However, such yellow couplers have been found to suffer from poor dye dark stability. Thus, a problem to be solved is to provide a pivaloylacetanilide yellow coupler containing an aryloxy COG but which exhibits improved dye dark stability.

A problem to be solved is to provide a silver halide photographic element which contains an active yellow dye forming coupler that does not exhibit poor dye dark stability.

SUMMARY OF THE INVENTION

The invention provides a photographic element comprising a light sensitive silver halide emulsion layer having associated therewith a yellow dye forming coupler having the formula:

(I)

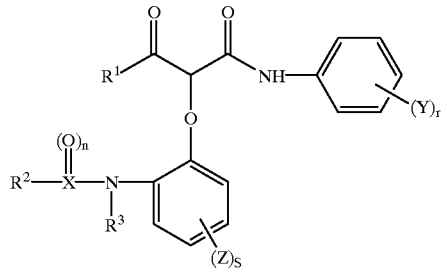

wherein:

$R^1$ and $R^2$ in the formula are independently selected alkyl, aryl, amino or heterocyclic groups, each free of hydrogen bonded to the atom linking the group to the rest of the coupler;

$R^3$ is a H or a substituent;

X is C, S, or P, and n is 1 or 2;

each Z is an independently selected substituent group substitutable to a phenyl ring provided that at least one such group is an electron withdrawing group and s is 1 to 3;

each Y is an independently selected substituent group and r is 1 to 3.

The invention also provides an imaging method, the yellow coupler itself, and the yellow dye formed upon coupling with a p-phenylendiamine developer. The element of the invention provides improved yellow dye dark stability.

DETAILED DESCRIPTION OF THE INVENTION

The photographic element of the invention contains a yellow dye-forming coupler as identified in the Summary of the Invention. The coupler may be represented by formula (I):

(I)

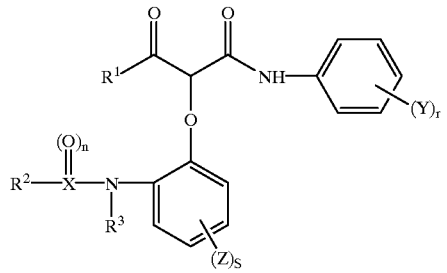

$R^1$ and $R^2$ in the formula are independently selected alkyl, aryl, amino or heterocyclic groups, each free of hydrogen bonded to the atom linking the group to the rest of the coupler. Suitable such groups include t-alkyl including t-butyl, encompassing substituted derivatives thereof such as t-pentyl, t-octyl, etc; adamantyl; 1-methylcyclopropyl; 5-methyl 1,3-dioxanyl; methylcyclohexyl; quinolyl; bicyclo [2.2.1] heptyl; bicyclo [2.2.2.]octyl; 2-methylbicyclo[2.1.1] hexyl; 2,7,7-trimethylbicyclo[2.2.1]heptyl; 1-[isoquinolyl] such as 1,2,3,4-tetrahydroisoquinoline; and 1-[indolyl]. Most suitable are t-butyl and its derivatives, the 1-alkyl substituted cycloalkyl compounds, and adamantyl.

$R^3$ may be hydrogen or any substituent such as alkyl or aryl groups. Hydrogen or methyl are conveniently used.

X may be C, S, or P, and n is 1 or 2. Thus, X may be —C(O)—, —$SO_2$—, or —$P(O)_2$— for example. The carbonyl group is typically the most convenient.

Each Y may be an independently selected substituent group substitutable to a phenyl ring. Examples include carbonamido, carboxyl, ester, sulfonamido, and sulfamoyl groups. "r" is 1 to 4. An ortho halogen or alkoxy substituent is particularly useful.

Each Z may be an independently selected substituent group substitutable to a phenyl ring provided that at least one such group is an electron withdrawing group. Such groups may be defined as those groups for which the Hammett's sigma para value is positive. The corresponding values for substituents may be found in numerous references such as *Substituent Constants for Correlation Analysis in Chemistry and Biology* by Hansch and Leo, Wiley, New York, N.Y., 1979. Examples of suitable groups are halogen, acyl, acylalkyl, nitro, cyano, trifluoromethyl, N,N-dimethylmethylcarbamoyl, sufonyl, sulfamoyl, carboxyl, and sulfonamido. "s" is 1 to 3.

While not wishing to be bound by theory, it is believed that increasing the steric hindrance of the ortho groups on the phenoxy coupling-off group serves to make hydrolytic attack on the pivaloyl group of the parent more difficult. This is confirmed when the coupler is subjected to hydrolysis testing at pH 11 using a phosphate buffer ($\mu$=0.375), 6% TX-100, 50° C., as shown in Table I.

TABLE I

Relative Stability of Couplers

| Coupler | COG o-substituent | Half-life (hrs) |
|---|---|---|
| C-1 | Me | 29 |
| C-2 | i-Pr | 44 |
| Y-1 | t-Bu | 99 |
| Y-2 | 1-Adamantyl | 112 |

Typical examples of couplers of the invention are as follows:

Y-1

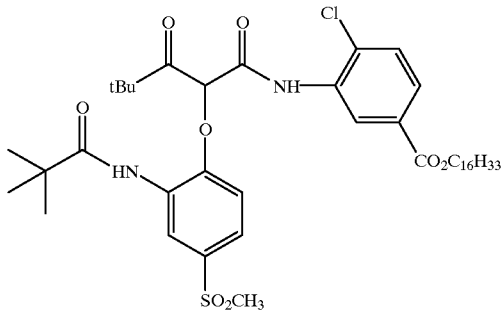

Y-2

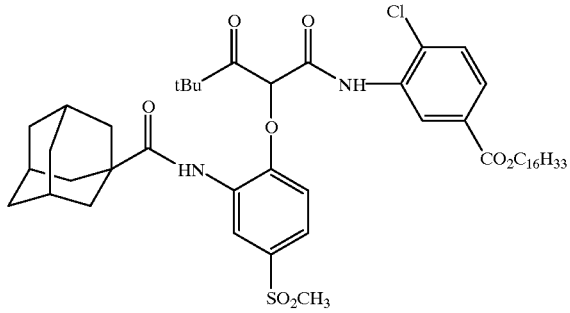

Y-3

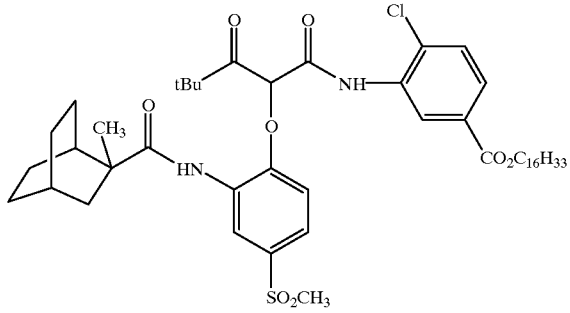

-continued
Y-4
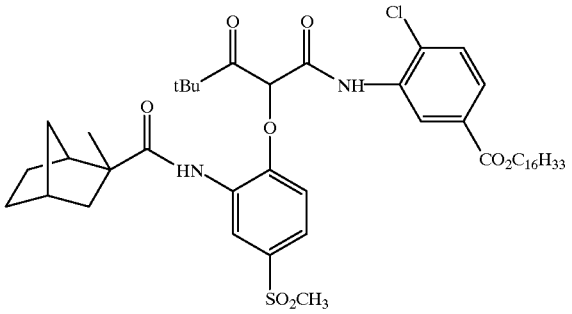
Y-5
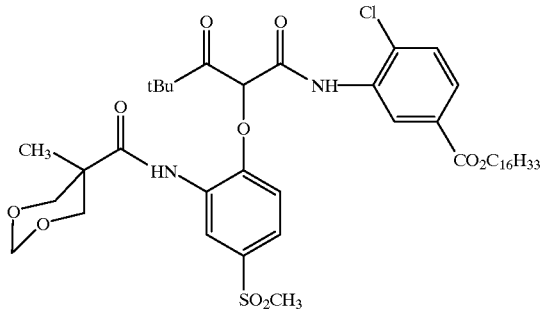
Y-6
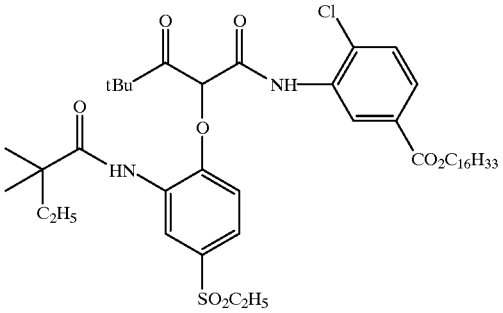
Y-7
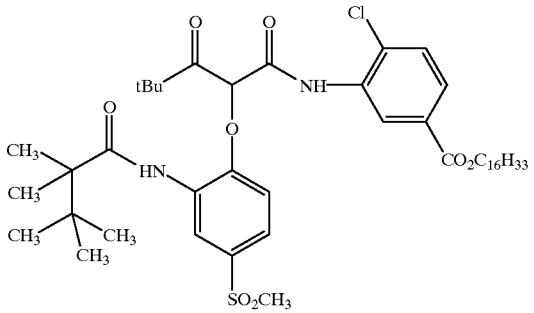
Y-8
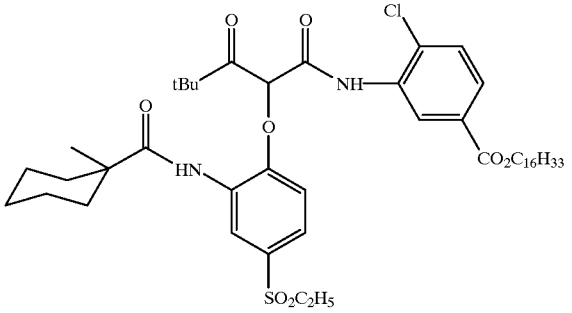

-continued
Y-9
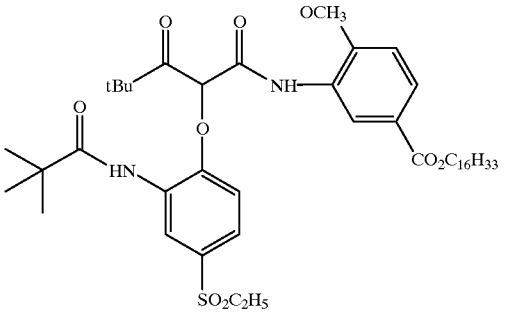
Y-10
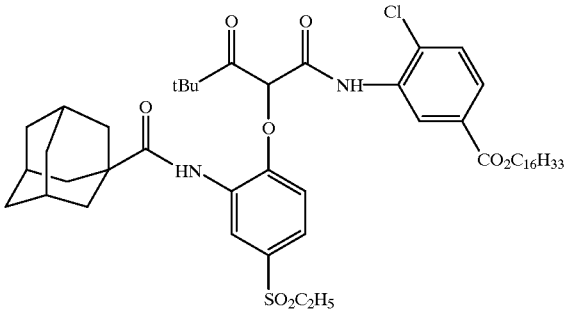
Y-11
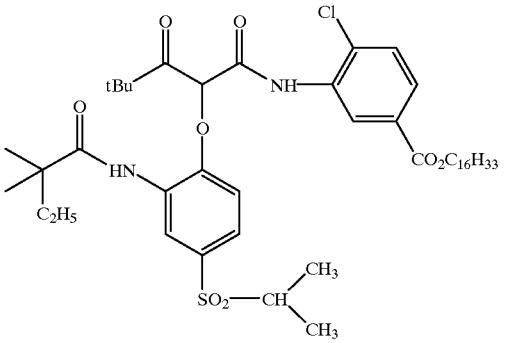
Y-12
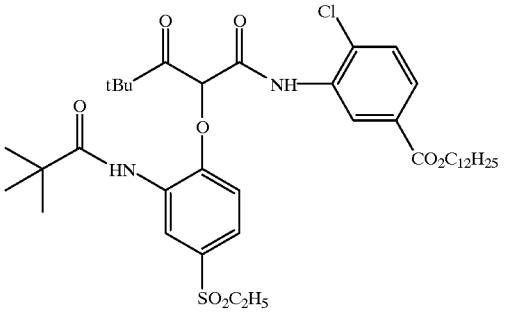

-continued
Y-13
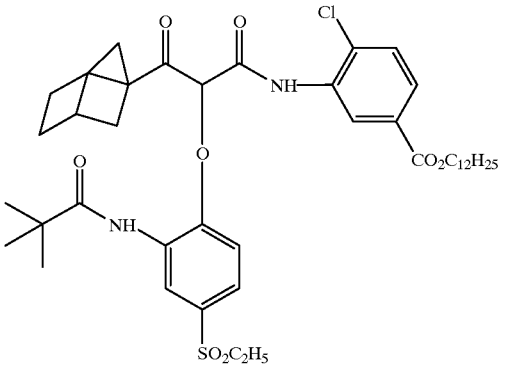
Y-14
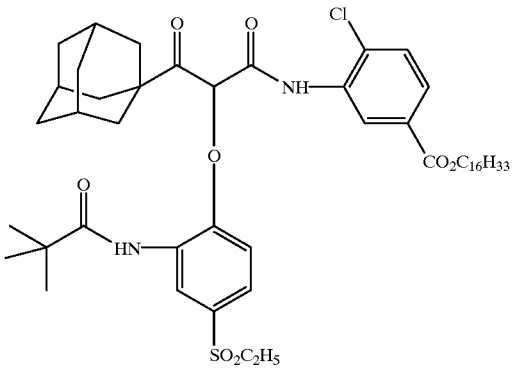
Y-15
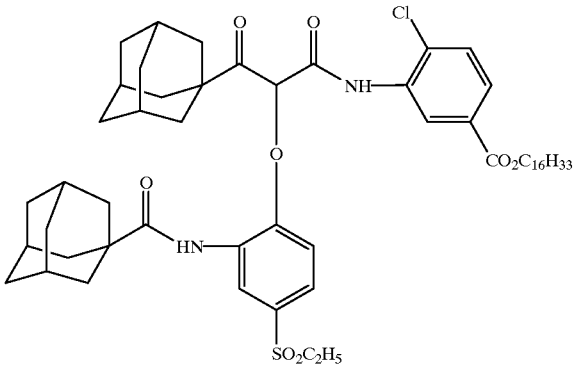
Y-16
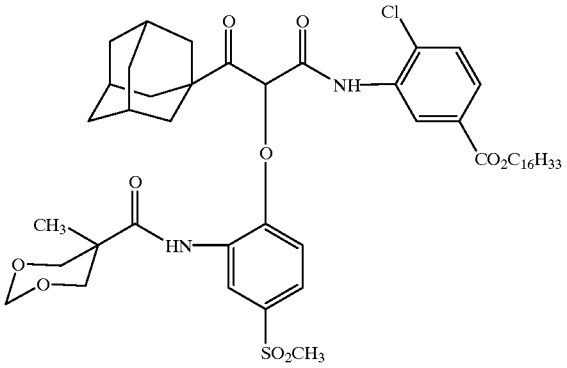

-continued
Y-17
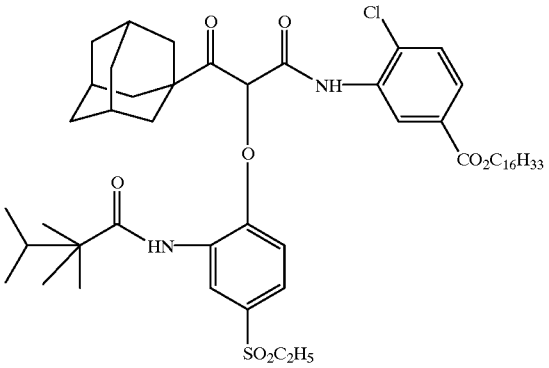
Y-18
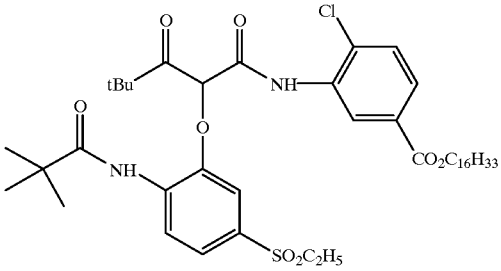
Y-19
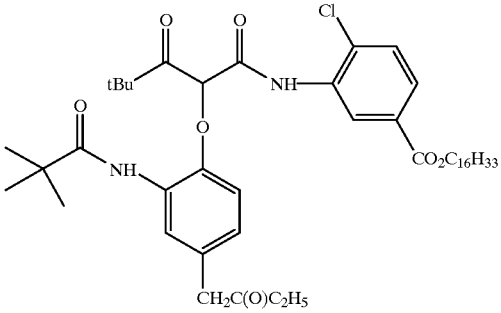
Y-20
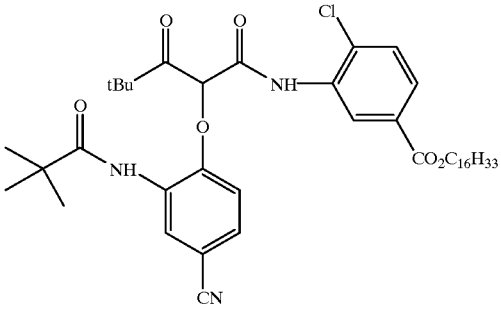
Y-21
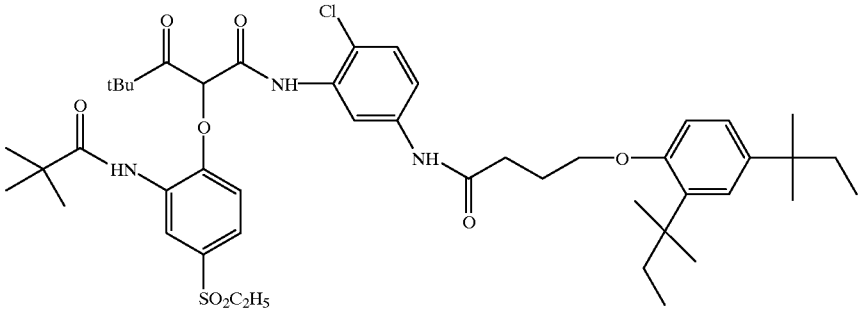

-continued
Y-22
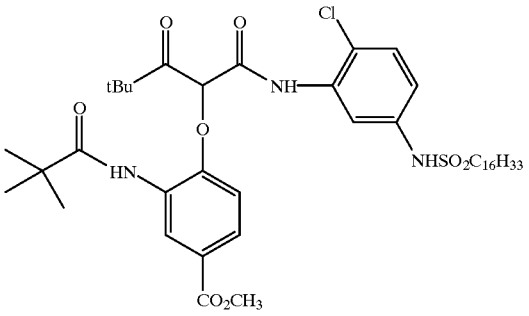
Y-23
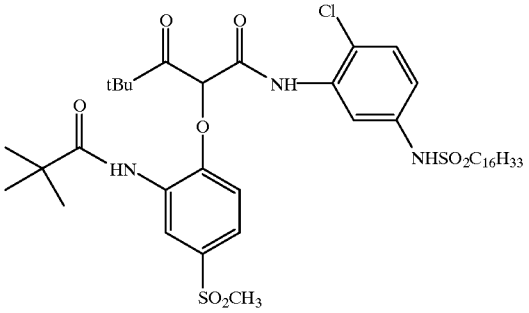
Y-24
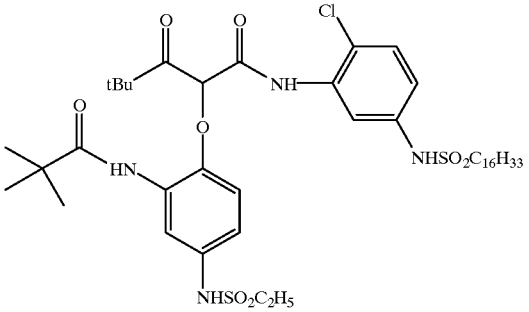
Y-25
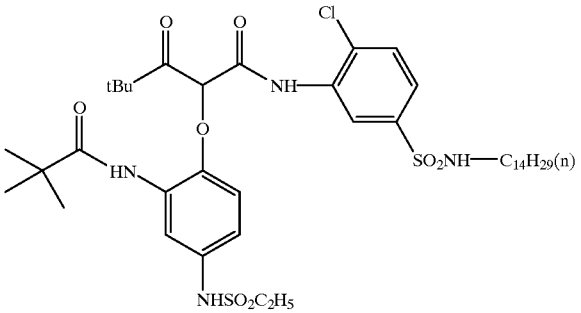
Y-26
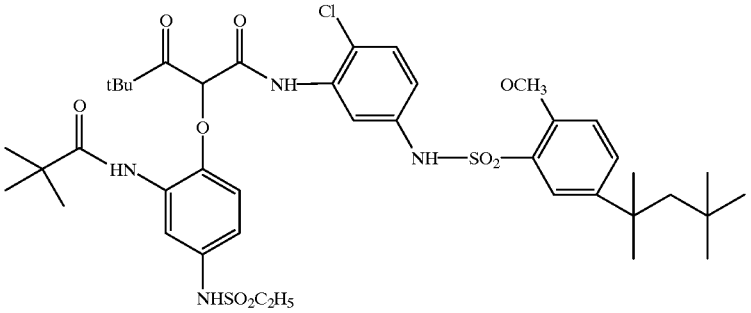

-continued
Y-27
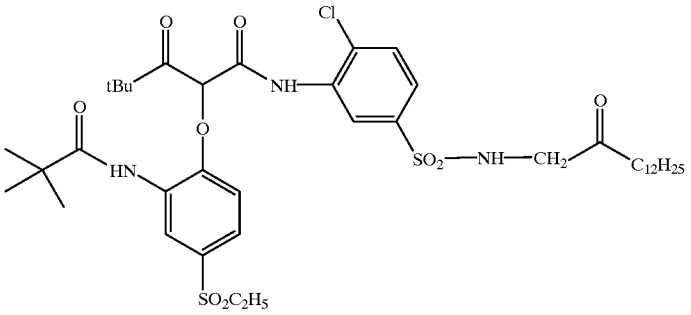
Y-28
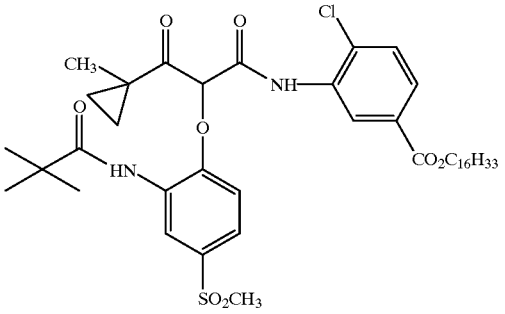
Y-29
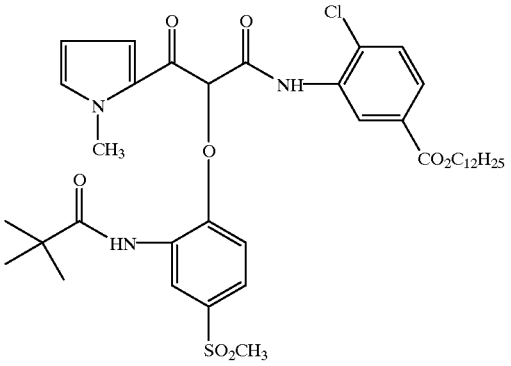
Y-30
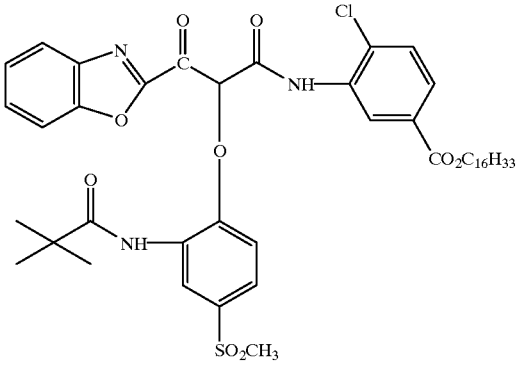

-continued
Y-31
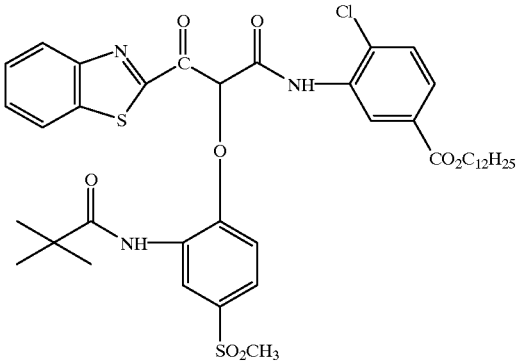
Y-32
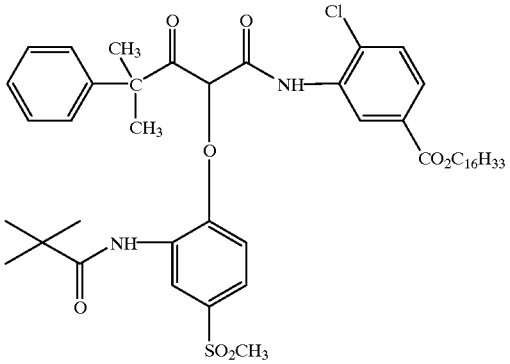
Y-33
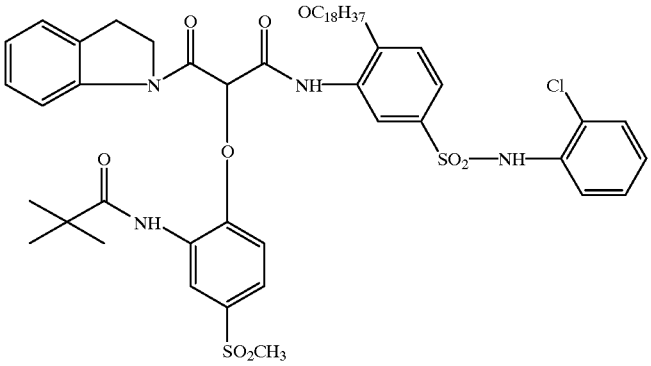
Y-34
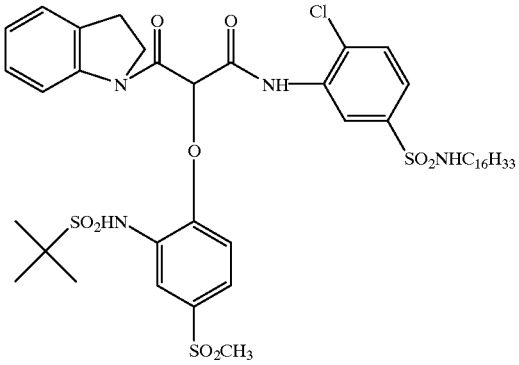

-continued

Y-35

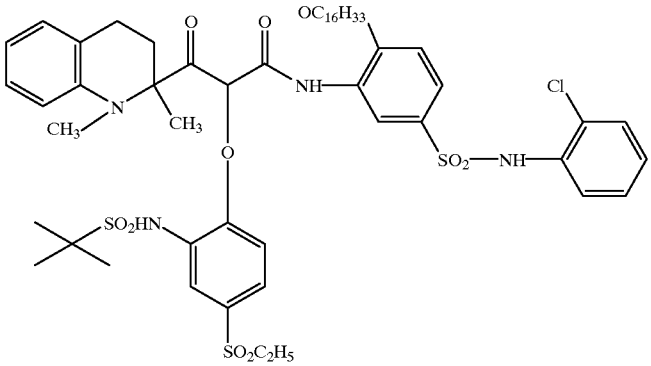

Y-36

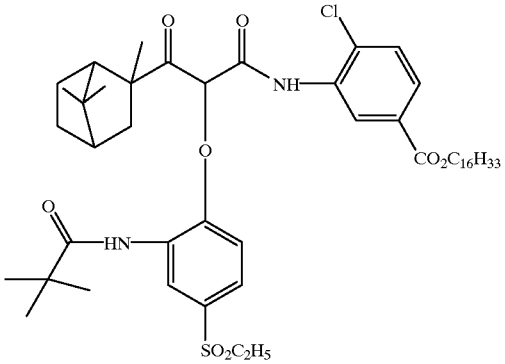

Y-37

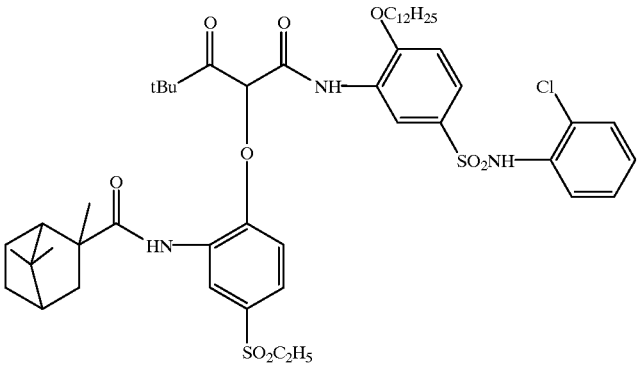

Unless otherwise specifically stated, when a substituent group contains a substitutable hydrogen, it is intended to encompass not only the substituent's unsubstituted form, but also its form further substituted with any group or groups as herein mentioned, so long as the group does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di -t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dioxo-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'- ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyt, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, intertayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure*, Item No. 36544 referenced above, is updated in the September 1996 *Research Disclosure*, Item No. 38957. Certain desirable photographic elements and processing steps, including those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, heterodoxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine Literature Ubersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine Literature Ubersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: UK. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,23 1; 2,181,944; 2,333,106; and 4,126,46 1; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful in conjunction with the compositions of the invention are knowvn in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,392; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

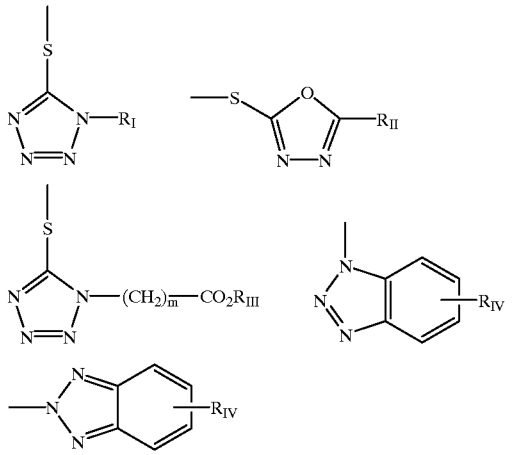

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —COORV and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. Nos. 4,438,193; 4,618,571) and groups that combine the features described above. It is typical that the timing group is of one of the formulas:

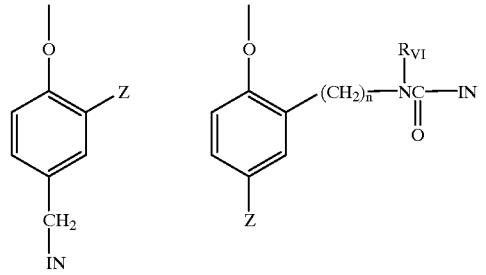

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down and unconjugated chain. Linking groups are known in the art under various names. Often they have been referred to as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1
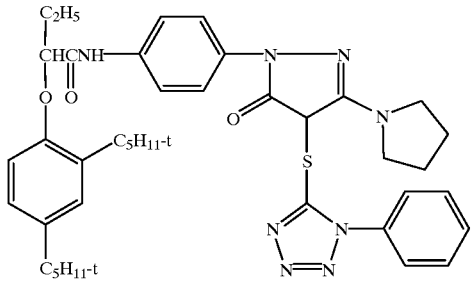
D2
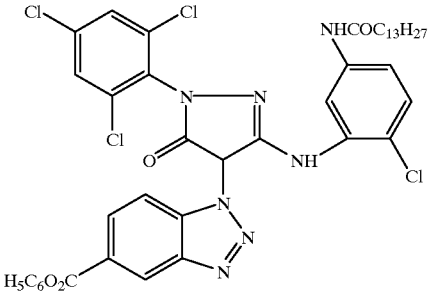
D3
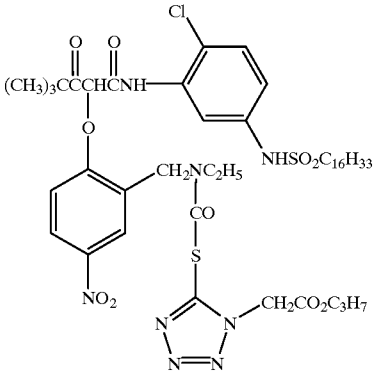
D4
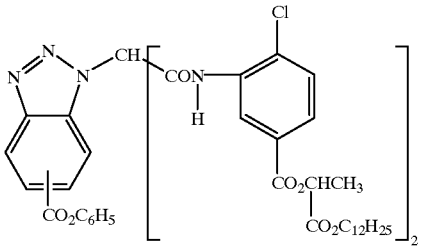
-continued
D5
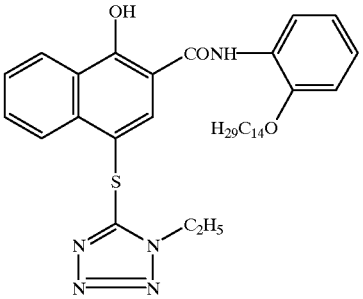
D6
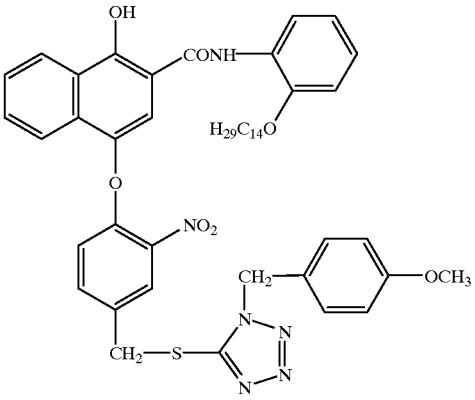
D7
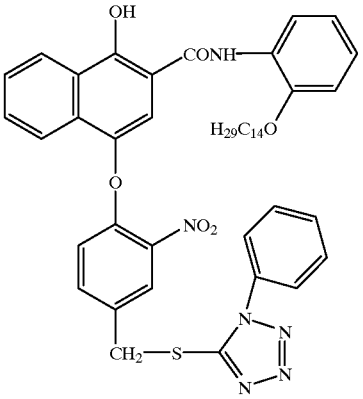
D8
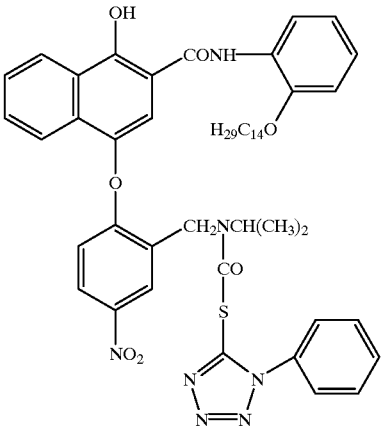

-continued

D9

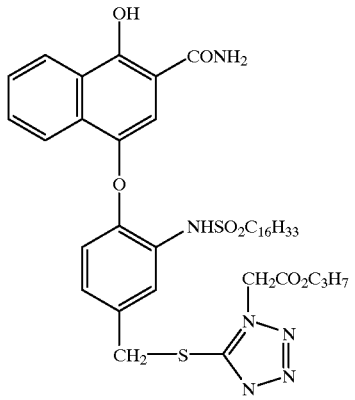

D10

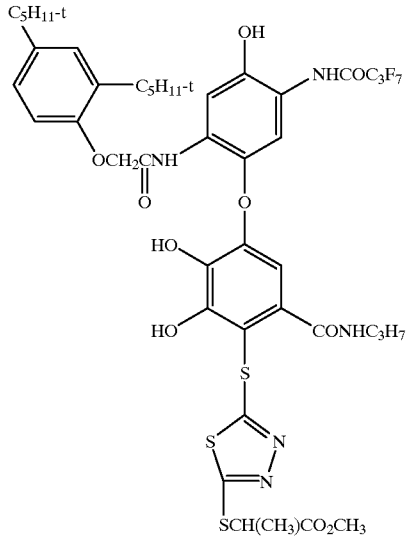

D11

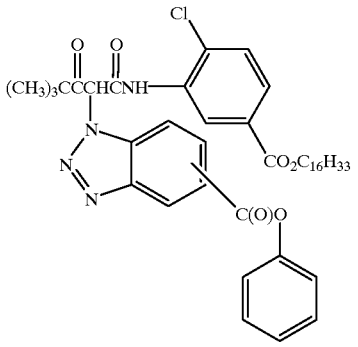

-continued

D12

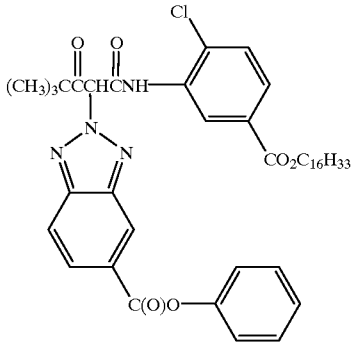

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.07 micrometer) tabular grains. Tabular grain thicknesses typically range down to about 0.02 micrometer. However, still lower tabular grain thicknesses are contemplated. For example, Daubendick et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions and may be processed, for example, in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

Another type of color negative element is a color print. Such an element is designed to receive an image optically printed from an image capture color negative element. A color print element may be provided on a reflective support for reflective viewing (e.g. a snap shot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The print may then be processed to form a positive reflection image using, for example, the Kodak RA-4 process as described in The British Journal of Photography Annual of 1988, Pp 198–199. Color projection prints may be processed, for example, in accordance with the Kodak ECP-2 process as described in the H-24 Manual. Color print development times are typically 90 seconds or less and desirably 45 or even 30 seconds or less.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6 process. Alternatively, a direct positive emulsion can be employed to obtain a positive image.

The above emulsions are typically sold with instructions to process using the appropriate method such as the mentioned color negative (Kodak C-41), color print (Kodak RA-4), or reversal (Kodak E-6) process.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-7m-toluidine di-p-toluene sulfonic acid.

Development is usually followed by the conventional steps of bleaching, fixing, or bleach-fixing, to remove silver or silver halide, washing, and drying.

The entire contents of the patent applications, patents and other publications referred to in this specification are incorporated herein by reference.

Coupler Synthesis

The couplers of the invention may be synthesized in accordance with the following general scheme:

1)

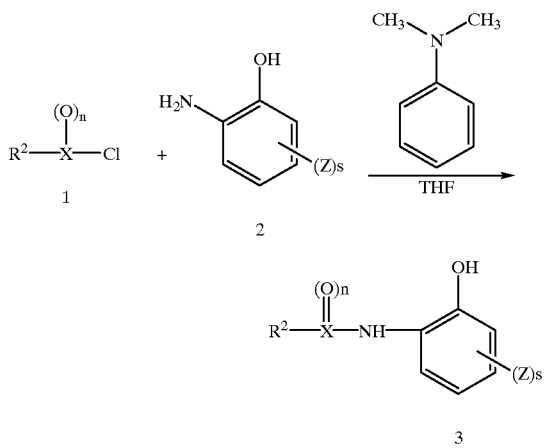

2)

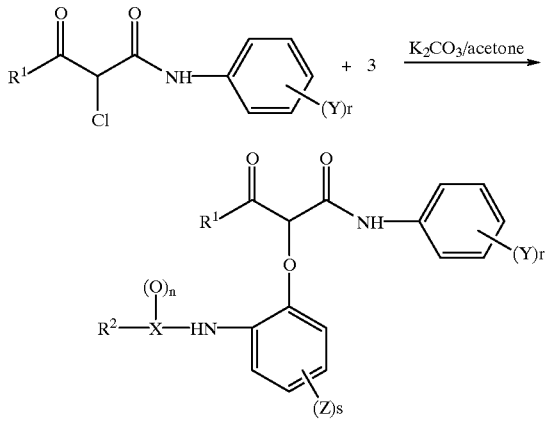

(Formula I)

The synthesis of the instant couplers is illustrated by the preparation of the yellow coupler (Y-2).

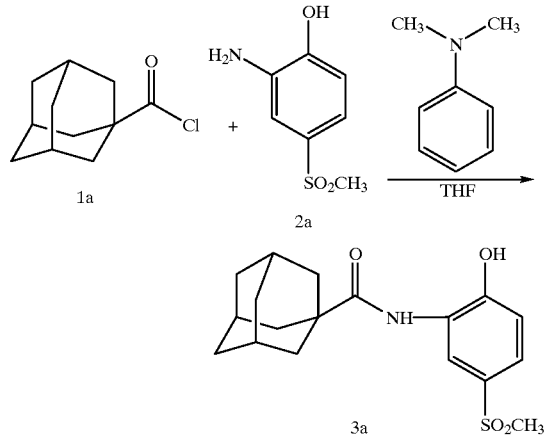

-continued

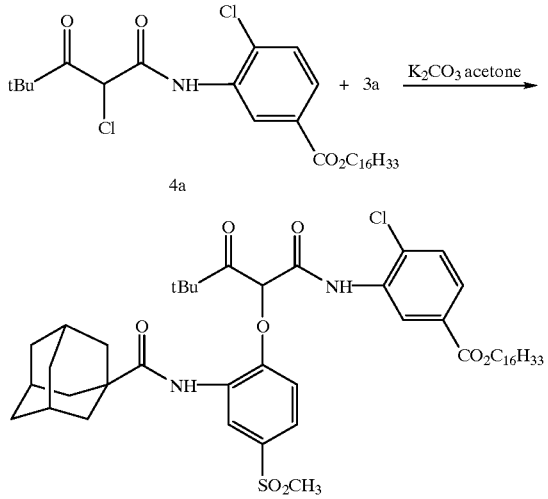

Y-2

Preparation of the intermediate: N1-[2-hydroxy-5-methylsulfonyl)phenyl]-1-adamantane carboxamide:3a To a stirred solution of 9.35 g (50 mmol) of 2-amino-4-(methylsulfonyl)phenol in 200 mL of dried THF cooled at 0° C. under nitrogen was added in one portion 6.36 g (52.5 mmol) of N,N-dimethlaniline, followed by the drop-wise addition of a solution of 10.98 g (52.5 mmol) of 1-adamantanecarbonyl choloride (95% pure) in 60 mL of THF. The reaction was allowed to warm to room temperature and stirred for 2 hr. The reaction mixture was poured into an iced water containing 11.20 g of concentreated HCl. Upon a vigorous stirring, a tan solid was formed and was collected under suction. The tan solid was washed with 200 mL of water (3 times) and dried in vacuo. The weight was 17.1 g (98%). It was used in the next step.

Preparation of hexadecyl 4-chloro-3-((2-(1-adamantylcarbonyl)amino)-4-(methylsulfonyl)phenoxy)-4,4-dimethyl-3-oxopentanoyl)amino)benzoate. (Y-2)

To a stirred solution of 11.20 g (20 mmol) of hexadecyl 4-chloro-3-[2-chloro-4,4-dimethyl-3-oxopentanoyl)amino] benzoate in 200 mL of dry acetone were added successfully 7.0 g (20 mmol) of N1-[2-hydroxy-5-(methylsulfonyl) phenyl]-1-adamantane carboxamide, 8.30 g (60 mmol) of anhydrous powdered potassium carbonate. The reaction was gently refluxed for 3 hr. Thin layer chromatography ($CH_3COOC_2H_5$/ligroin:1/1) indicated the completion of the reaction. The reaction mixture was cooled to room temperature, filtered and concentrated in vacuo to yield an oil. The oil was dissolved in ethyl acetate and the ethyl acetate solution was washed with a diluted aqueous hydrochloric acid, with water/brine, dried over an hydrous magnesium sulfate, filtered and concentrated in vacuo to yield 19.3 g of oil which was purified by flash column chromatography on silica gel using a solvent gradient to 50% of ethyl acetate in ligroin for elution to afford 13.36 g (71%) of yellow coupler (Y-2) as a white solid. All analytical data confirmed the assigned structure.

Photographic Examples

The following experiments demonstrate the invention. The formulas for the comparison couplers were:

(C-1)
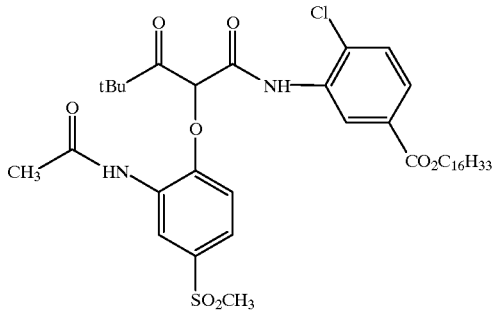
(C-2)
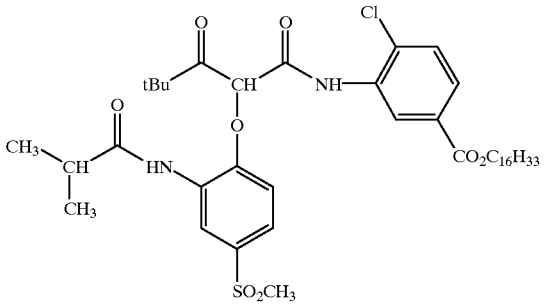
(C-3)
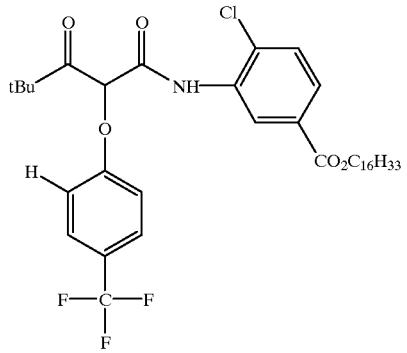
(C-4)
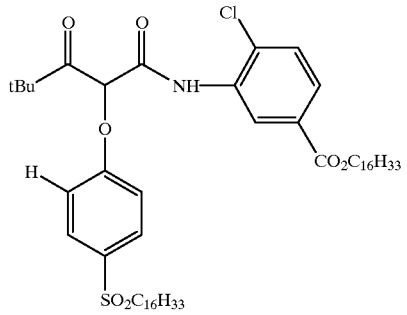
-continued
(C-5)
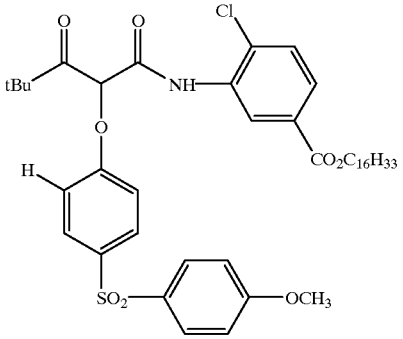
(C-6)
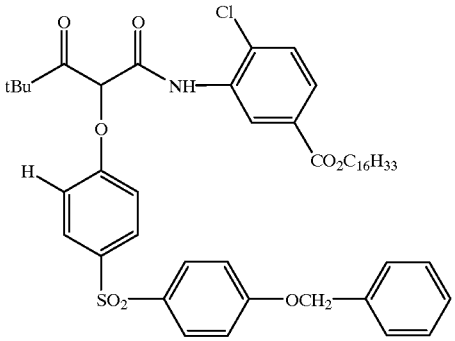
(C-7)
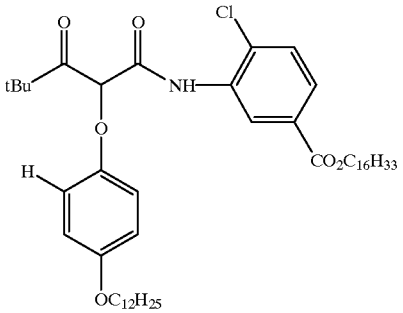
(C-8)
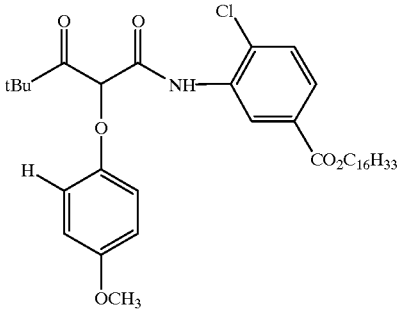
The inventive couplers were tested to determine whether the improvements in dark (heat/wet) stability of the yellow image dye is due to the substituent attached to the ortho position of the coupler's coupling-off group. The types of couplers tested are identified in Table II.

TABLE II

| Couplers | Type | Within this invention? Yes (Y) No (N) |
|---|---|---|
| Y-1 | Invention | Y |
| Y-2 | Invention | Y |
| C-1 | Comparative | N |
| C-2 | Comparative | N |
| C-3 | Comparative | N |
| C-4 | Comparative | N |
| C-5 | Comparative | N |
| C-6 | Comparative | N |
| C-7 | Comparative | N |
| C-8 | Comparative | N |

Samples 1–10

Photographic elements were prepared by coating a cellulose acetate-butyrate film support with a photosensitive layer containing a silver bromolodide emulsion at 0.86 g/m$^2$ Ag, gelatin at 3.23 g/m$^2$ and one of the couplers designated in Table I dispersed in di-n-butylphthalate (weight ratio coupler/coupler solvent: 1:½ and coated at 2.69 mmol/m$^2$. The photosensitive gelatin was at 0.969 g/m$^2$ and bisvinylsulfonylmethyl ether at 1.9 weight percent based on total gelatin. Samples of each element were imagewise exposed through a graduated density test object and processed at 40° C. employing the process steps and processing solutions as used in the Kodak E-6 process of Eastman Kodak Company (British Journal of Photography Annual, 1988, p. 194).

The dark stability was determined after maintaining the samples at 60° C. at 70% relative humidity (RH) for 6 weeks. The results were as follows:

TABLE III

| Couplers | Type | Loss of the original density at D = 1.0 after 6 weeks at 60° C. and 70% RH. |
|---|---|---|
| Y-1 | Invention | −0.15 |
| Y-2 | Invention | −0.08 |
| Avg | Invention | −0.12 |
| C-1 | Comparative | −0.21 |
| C-2 | Comparative | −0.25 |
| C-3 | Comparative | −0.29 |
| C-4 | Comparative | −0.28 |
| C-5 | Comparative | −0.24 |
| C-6 | Comparative | −0.20 |
| C-7 | Comparative | −0.33 |
| C-8 | Comparative | −0.42 |
| Avg | Comparative | −0.27 |

The results of the above table show the advantages of this invention. The data indicates that the improvements in dark stability of the yellow image dye is due to the particular $R_2$ ortho substituent in the coupling-off group of the couplers. The invention exhibits a loss of from 8 to 15 percent of the dye density while the comparisons vary from 20 to over 40 percent. The instant couplers thus provide improved dye dark stability.

The invention has been described in detail with particular reference to certain preferred embodiments thereof, but it will be understood that variations and modifications can be effected within the spirit and scope of the invention.

What is claimed is:

1. A photographic element comprising a light sensitive silver halide emulsion layer having associated therewith a yellow dye forming coupler having the formula:

(I)

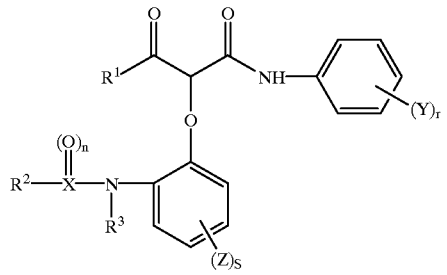

wherein:

$R^1$ is an alkyl group and $R^2$ is a t-alkyl group, each free of hydrogen bonded to the atom linking the group to the rest of the coupler;

$R^3$ is a H or a substituent;

X is C, S, or P, and n is 1 or 2;

each Z is an independently selected substituent group substitutable to a phenyl ring provided that at least one such group is an electron withdrawing group and s is 1 to 3;

each Y is an independently selected substituent group and r is 1 to 3.

2. The element of claim 1 wherein X is C and n is 1.

3. The element of claim 1 wherein $R^2$ is a t-butyl, methylcyclopropyl, or adamantyl group.

4. The element of claim 1 wherein at least one group Z is para to the phenoxy oxygen group.

5. The element of claim 4 wherein Z is an electron withdrawing group.

6. The element of claim 5 wherein the Z para to the phenoxy oxygen is selected from the group consisting of halogen, acyl, acylalkyl, nitro, cyano, trifluoromethyl, N,N-dimethylmethylcarbamoyl, sufonyl, sulfamoyl, carboxyl, and sulfonamido groups.

7. The element of claim 5 wherein the Z group para to the phenoxy oxygen is selected from the group consisting of sulfonyl, carboxyl, sulfonamido, carbamoyl, and sulfamoyl.

8. The element of claim 7 wherein the Z group para to the phenoxy oxygen is a sulfonyl group.

9. The element of claim 1 wherein $R^1$ is a t-alkyl group.

10. The element of claim 9 wherein $R^1$ is tertiary butyl.

11. The element of claim 1 wherein X is S and n is 2.

12. The element of claim 1 wherein X is S and n is 1.

13. The element of claim 1 wherein X is P and n is 1.

14. The element of claim 1 wherein X is P and n is 2.

15. A film package comprising the element of claim 1 containing written instruction to process using a reversal development process.

16. The element of claim 1 wherein $R^2$ is selected from t-butyl, t-pentyl, t-octyl, adamantyl, 1-methylcyclopropyl, methylcyclohexyl, bicyclo(2.2.1) heptyl, bicyclo (2.2.2.) octyl, 2-methylbicyclo(2,1,1)hexyl, and 2,7,7-trimethylbicyclo(2,2,1)heptyl.

* * * * *